United States Patent [19]

Auriemma

[11] 4,102,135

[45] Jul. 25, 1978

[54] UNDERGROUND DRAINAGE PIPE

[76] Inventor: Robert Sinbad Auriemma, R.D. No. 1, P.O. Box 104, Bethel, Pa. 19507

[21] Appl. No.: 783,767

[22] Filed: Apr. 1, 1977

Related U.S. Application Data

[63] Continuation-in-part of Ser. No. 682,492, May 3, 1976, Pat. No. 4,065,925.

[51] Int. Cl.[2] ..... E02B 11/00

[52] U.S. Cl. ..... 61/10; 61/13

[58] Field of Search ..... 61/10, 11, 12, 13; 138/121

[56] References Cited

U.S. PATENT DOCUMENTS

| | | | |
|---|---|---|---|
| 2,782,805 | 2/1957 | Leadbetter | 61/10 X |
| 3,681,925 | 8/1972 | Schmunk et al. | 61/11 |

FOREIGN PATENT DOCUMENTS

| | | | |
|---|---|---|---|
| 234,055 | 6/1964 | Austria | 61/10 |
| 13,689 of | 1904 | United Kingdom | 61/10 |
| 511,677 | 8/1939 | United Kingdom | 61/11 |

*Primary Examiner*—Mervin Stein
*Assistant Examiner*—David H. Corbin
*Attorney, Agent, or Firm*—Thomas Hooker

[57] ABSTRACT

An extruded plastic drainage pipe having long narrow drainage openings with a width of about one eighth inch to limit the flow of particulate matter through the openings and into the pipe. The circumferential extend of the trough is greater than that of the roof and the thickness of both the roof and trough decrease from either side of the centers thereof. The lips of the trough join the roof at approximately 90° to provide a construction particularly adapted to withstand high loading forces without collapse.

4 Claims, 3 Drawing Figures

Fig. 1
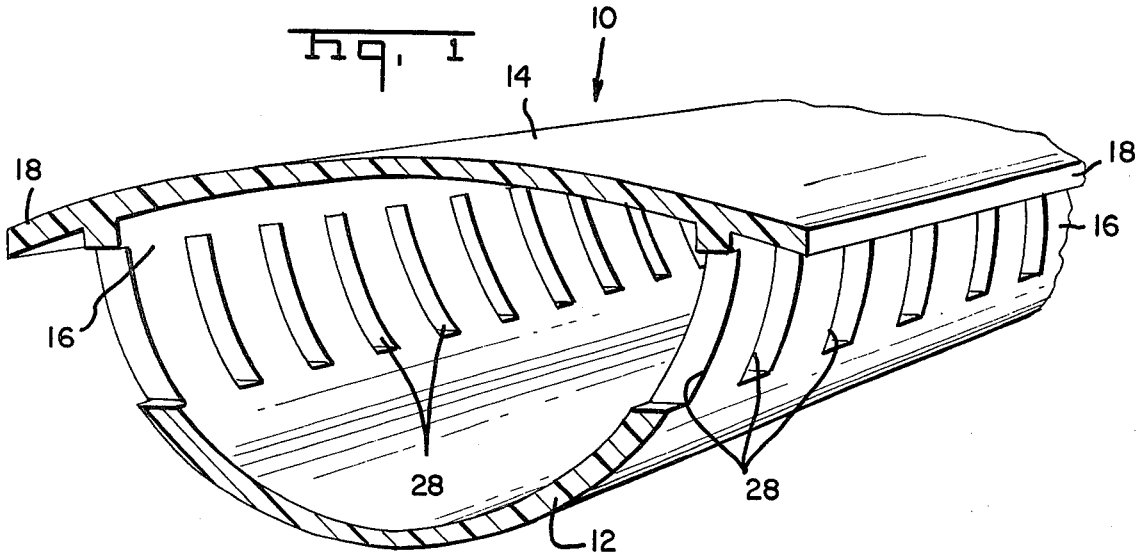
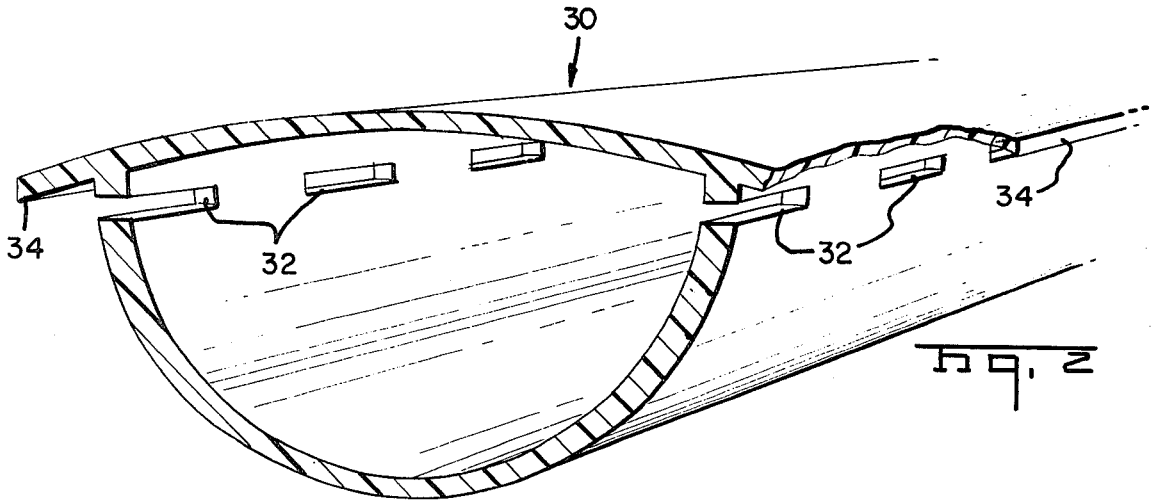
Fig. 2
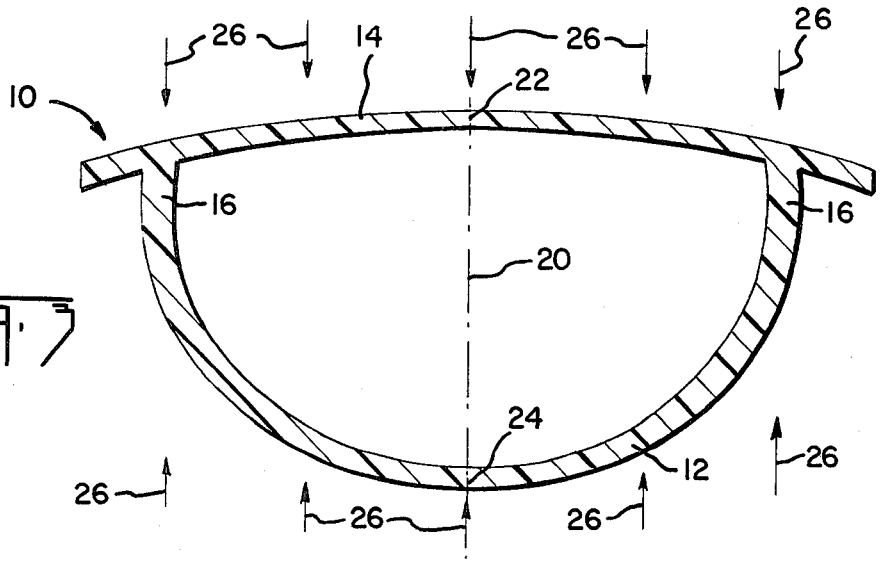
Fig. 3

UNDERGROUND DRAINAGE PIPE

This application is a continuation-in-part of my copending application for "Underground Drainage Pipe", Ser. No. 682,492, filed May 3, 1976 which issued on Jan. 3, 1978 as U.S. Pat. No. 4,065,925.

This invention relates to underground drainage pipes and particularly extruded plastic underground drainage pipes having an uniform transverse cross section where drainage openings are formed through the walls of the pipe to permit water in the surrounding soil to flow into the pipe. Reading U.S. Pat. No. 460,352 discloses a conventional cylindrical ceramic drain tile with round drainage openings located beneath protecting wings. Neyland U.S. Pat. No. 3,333,422 discloses a cylindrical subterranean conduit having round drainage openings formed therein under protective flanges. Schmidt et al. U.S. Pat. No. 2,663,997 discloses a metal drainage pipe having a trough and an overlying roof where the circumferencial length of the roof is less than that of the trough. This type of pipe is expensive to manufacture and install and is not now commercially viable.

The improved underground drainage pipes of the invention are conventionally manufactured by an extrusion operation. The pipes are of indefinate length with an arcuate trough and an integral overlying roof joining the trough at the upwardly projecting trough lips so that in cross section the circumferencial extent of the roof between the lips is less than the circumferential extent of the trough. Preferably the roof extends beyond the trough lips to provide protective wings which aid in preventing granular filter material from clogging the drainage openings. A series of spaced long, narrow drainage slots is formed on each trough lip adjacent the wing to permit excess ground water to be drained from the surrounding soil and into the pipe. The slots have a width of approximately one-eighth inch to prevent particulate matter from being drawn into the trough. In this way, relatively large particulate matter is kept out of the trough and cannot be drawn within the drainage system to form dams to obstruct the flow of water through the system. The total area of the slots is comparable or greater than the area of drainage openings provided in conventional underdrainage pipes so that the use of slots does not impare the drainage capacity of the pipe. By providing the long narrow drainage slots as described it is possible to surround the drainage pipe with a single element granular filter material as opposed to the two-element granular filter material required for underground drainage pipes using the conventional larger cylindrical drainage openings.

The thickness of the trough and roof walls increases gradually from a minimum thickness at the center thereof to a maximum thickness at the junction between the trough and roof. This uniform tapering in thickness assures that when the underground drainpipe is subjected to vertical loading forces the resultant stresses in the walls are distributed uniformly around the circumference of the pipe and stress buildup is avoided. The lips of the trough join the roof at an angle of approximately 90° so that with flattening of the roof to a horizontal position, the lips are moved to a strong vertical column-loaded position.

Other objects and features of the invention will become apparent as the description proceeds, especially when taken in conjunction with the accompanying drawings illustrating the invention, of which there is one sheet.

IN THE DRAWINGS

FIG. 1 is a broken away perspective view illustrating an underground drainage pipe according to one embodiment of the invention;

FIG. 2 is a view similar to FIG. 1 illustrating another embodiment of the invention; and FIG. 3 is a sectional view taken through FIG. 1 illustrating the cross section of the pipe.

Referring to FIG. 1, underground drainage pipe 10 is formed from a plastic extrusion of indefinate length having a trough 12, a roof 14 overlying the trough and joining the trough at trough lips 16 with protective wings 18 forming a continuation of the roof and extending outwardly beyond the trough lips. As illustrated more clearly in FIG. 3, the transverse cross section of pipe 10 is symmetrical to either side of a plane 20 extending between the circumferencial center point 22 of the roof 14 and the circumferencial center point 24 of trough 12. The thickness of the trough is at a minimum at center point 24 and gradually and uniformally increases to either side of the center point to a maximum thickness at the lips 16 where it integrally joins the roof 14. Likewise the thickness of the roof is at a minimum at center point 22 and increases gradually and uniformly to either side of the centerpoint to a maximum at the lips. The lips extend away from the roof at approximately 90°.

A series of long, narrow slot-type drainage openings 28 are formed through the thickness of each trough lip 16 at spaced intervals along the length of the pipe. As illustrated in FIG. 1, the openings 28 extend longitudinally along the circumference of the trough away from the roof.

Underground drainage pipe 10 is intended to be buried in soil so that excess water in the soil will drain through openings 28 and into the trough. The water then flows along the trough to a suitable discharge point. While it is conventional for underground drainage pipes to be surrounded by granular filter material which is capable of quickly removing free water from soils, specialized two-element granular filter material has been required in order to prevent solids from being drawn with the water into the pipe and then along the drainage system. These solids tend to collect at discontinuties in the drainage systems and may cause dams or obstructions which inhibit proper drainage. The narrow slotted drainage openings 28 permit use of one element granular filter to effectively prevent solids from being drawn into the drainpipe. While wings 18 prevent solids from being packed unduly tightly around the drainage openings during installation of the drainage pipe, the wings do not completely prevent solids from being drawn into the drainage system following installation.

When buried, underground drainage pipe may be subjected to high compressive loadings which, in the past, have frequently deformed and broken conventional pipe. This type of high loading may be experienced when underground drainage pipe is buried beneath or adjacent concrete roadways where the ground is saturated with water so that it is unable to support heavy loads. In this case, the underground drainage pipe is subjected to vertical loading forces, represented by arrows 26 in FIG. 3. Because the circumferencial extent of the trough is greater than that of the roof, the loading tends first to flatten the roof and then buckle the trough. This buckling causes high stress loading in the walls of the trough and roof which, if stresses were allowed to concentrate at any particular point, could easily rupture the walls. The concentration of stress at any point along the circumference of the trough walls is avoided by tapering the thickness of the walls from a minimum at the lower center point 24 to a maximum at their juncture with the roof at lips 16. When loaded the stress is distributed along the width of the tapered walls and does not concentrate at a given place. Stress is likewise distributed along the width of the roof.

The distribution of stress in pipe 10 is more uniform than in walls of uniform thickness pipes and represents a particular advantage for an underground drainage pipe of the present type where the roof and trough have different circumferencial extent. For instance, where the roof forms a continuation of the trough so that the pipe would have a circular or cross section, compresive loading of the pipe would flatten and crack the pipe at the top of the trough. By providing a relatively flat roof overlying the inlet openings 28, it is possible to reduce the amount of material used in the pipe so that production costs are minimized. The tapered trough sidewalls provide required strength for this economical type of underdrain pipe.

The lips 18 join the roof at approximately 90° so that when the roof is collapsed, the lips extend at an angle of about 90° thereto and are column loaded. This combination of features, tapering of thickness of the roof and trough to either side of the center of the pipe and the perpendicular junction between the trough lips and roof, result in a particularly strong underground drainage pipe capable of withstanding loading forces substantially greater than a conventional underground drainage pipe with walls of the same thickness could withstand. A pipe with a uniform thickness roof but with a tapered trough and approximately 90° lip-roof junctions is stronger than conventional pipe with uniform thickness walls, although not quite as strong as pipe 10. This means as a practical matter, that it is possible to manufacture underground drainage pipe with thinner walls using less plastic so that the walls are thinner while retaining the strength characteristics of the conventional pipe. Alternatively, the use of thicker walls would result in an even stronger pipe.

FIG. 2 illustrates an underground drainage pipe 30 similar to pipe 10 with the exception that the drainage openings 32 are long narrow slots extending longitudinally along the trough lips immediately beneath the protecting wings 34. By positioning the slots in this manner, it is possible to remove the drainage openings further from the surrounding granular filter material and that way minimize the possibility that particulate material is drawn into the trough with underground water which flows into the pipe. This advantage is partially offset by the fact that the longitudinally extending slots 32 weaken the drainpipe 30 somewhat more than the circumferencially extending slots 28 weaken pipe 10.

The drainage slots 28 and 32 of underground drainage pipes 10 and 13 have a sufficient length and width to provide a greater flow area than the area of the round drainage holes formed in conventional underdrain pipes. For instance, in an underdrain pipe like pipe 10 having a semi-cylindrical trough with a radius of two inches the drainage openings 28 may be one inch in length with a width of one eighth inch. The slots are preferably spaced at one inch intervals along the trough lips. In the embodiment of FIG. 2, slots 32 may also be one eighth inch wide and one inch long and separated by the same one inch spacing along the lips. The spacing between the slots may be varied as desired in order to control the drain capacity of the pipe.

While I have illustrated and described preferred embodiments of my invention, it is understood that this is capable of modification, and I therefore do not wish to be limited to the precise detailes set forth, but desire to avail myself of such changes and alterations as fall within the purview of the following claims.

What I claim my invention is:

1. An underground drainage pipe formed of a length of extruded stiffly flexible plastic and adapted to withstand vertical loading forces without stress concentration including in transverse cross section, a generally U-shaped trough opening upwardly with lips at the upper trough edges, the horizontal width of the trough between the lips being approximately twice the vertical height of the trough from the bottom thereof to a line joining the lips; a series of spaced drainage openings formed through the thickness of each lip; a generally flat roof overlying the trough and integrally joining the trough beyond the lips so that the roof and trough are substantially D-shaped in transverse cross section, roof extensions projecting outwardly of the trough beyond the lips to form protective wings; said lips joining said generally flat roof at an angle of approximately 90°, the circumferencial length of the roof between the lips being substantially less than the circumferencial length of the trough between the lips, said pipe being symmetrical to either side of a plane passing through the mid points of the trough and roof, and said trough having a minimum thickness at its mid point and increasing in thickness smoothly and gradually to either side of the mid point to a maximum thickness at the lips whereby upon vertical loading of the pipe the uniform tapering of thickness in the trough distributes stresses along the trough to avoid stress concentration.

2. An underground drainage pipe as in claim 1 wherein each opening has a longitudinal axis lying in a plane perpendicular to the longitudinal axis of the pipe.

3. An underground drainage pipe as in claim 2 wherein each drainage opening has a rectangular shape and a width of about ⅛ inch.

4. An underground pipe as in claim 1 wherein the roof has a minimum thickness at its mid point and the thickness increases smoothly and gradually to either side of the mid point to a maximum thickness at the lips.

* * * * *